US010658742B2

(12) United States Patent
Taira

(10) Patent No.: US 10,658,742 B2
(45) Date of Patent: May 19, 2020

(54) ANTENNA DEVICE

(71) Applicant: HARADA INDUSTRY CO., LTD., Tokyo (JP)

(72) Inventor: Kenji Taira, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 136 days.

(21) Appl. No.: 15/863,021

(22) Filed: Jan. 5, 2018

(65) Prior Publication Data

US 2018/0198195 A1 Jul. 12, 2018

(30) Foreign Application Priority Data

Jan. 12, 2017 (JP) ..... 2017-003044

(51) Int. Cl.

| | |
|---|---|
| ***H01Q 1/42*** | (2006.01) |
| ***H01Q 1/32*** | (2006.01) |
| ***H01Q 1/12*** | (2006.01) |

(52) U.S. Cl.

CPC ..... *H01Q 1/42* (2013.01); *H01Q 1/12* (2013.01); *H01Q 1/3275* (2013.01); *H01Q 1/427* (2013.01)

(58) Field of Classification Search

CPC ..... H01Q 1/42; H01Q 1/12; H01Q 1/3275

See application file for complete search history.

(56) References Cited

U.S. PATENT DOCUMENTS

| | | | | |
|---|---|---|---|---|
| 9,627,745 | B2 * | 4/2017 | Hayashi | H01Q 1/42 |
| 2007/0046551 | A1 | 3/2007 | Tateno | |
| 2014/0125549 | A1 | 5/2014 | Kaneko | |
| 2016/0020507 | A1 | 1/2016 | Kobayashi | |

FOREIGN PATENT DOCUMENTS

| | | | |
|---|---|---|---|
| CN | 1856902 | A | 11/2006 |
| CN | 102039700 | A | 5/2011 |
| CN | 103548199 | A | 1/2014 |
| CN | 105009358 | A | 10/2015 |
| EP | 1633015 | A1 | 3/2006 |
| JP | 2014-033461 | A | 2/2014 |

OTHER PUBLICATIONS

Office Action in the corresponding Chinese Patent Application No. 201810004538.8, dated Aug. 16, 2019.

Office Action in the corresponding Chinese Patent Application No. 201810004538.8, dated Feb. 25, 2020.

* cited by examiner

*Primary Examiner* — Graham P Smith

(74) *Attorney, Agent, or Firm* — Global IP Counselors, LLP

(57) ABSTRACT

An antenna device includes an antenna base including a plurality of first fitting parts, the plurality of first fitting parts being arranged with mutual spaces therebetween in a periphery edge part of the antenna base, an antenna case fixed to the antenna base, an antenna part arranged in a space enclosed by the antenna base and the antenna case, and a cover member including a plurality of a second fitting parts, each of the plurality of the second fitting parts fitting with each of the plurality of the first fitting parts.

15 Claims, 14 Drawing Sheets

ANTENNA DEVICE

CROSS REFERENCE TO ACCORDING APPLICATIONS

This application is based upon and claims the benefit of priority from the prior Japanese Patent Application No. 2017-0034044, filed on Jan. 12, 2017, the entire contents of which are incorporated herein by reference.

FIELD

An embodiment of the present invention is related to an antenna device. In particular, the present invention is related to an antenna device attached to a roof of a vehicle.

BACKGROUND

An antenna device attached on a roof of a vehicle is applied to a wide variety of vehicles as an antenna device attached on a vehicle. The antenna device attached on the roof of the vehicle is required to have a design that does not impair the aesthetic appearance of the vehicle or a design that improves aerodynamic characteristics during running of the vehicle. The development of an antenna device called a shark fin antenna which is streamlined and becomes thinner toward the front of the vehicle is proceeding as the antenna device mentioned above. An antenna case of a shark fin antenna is formed from a resin material with high strength in order to suppress damage due to external pressure or impacts. However, since the roof of the vehicle is scratched when the antenna case and the roof of the vehicle come into contact with each other, a cover member is arranged between the antenna case and the roof of the vehicle (for example, Japanese Laid-Open Patent Publication No. 2014-33461). The cover member maintains a space between the antenna case and the roof of the vehicle and blinds a gap between the two.

However, in Japanese Laid-Open Patent. Publication No. 2014-33461, since a collar part 20*b* of an insulating base 20 is required to be screwed into a groove part 18*a* of a gap cover 18 when attaching the gap cover 18 to the insulating base 20, workability of the attachment is low. Furthermore, in Japanese Laid-Open Patent Publication No. 2014-33461, it was inconvenient that it cannot be confirmed visually or by touch that the groove part 18*a* is fitted into the collar part 20*b*. Both are welded together after the gap cover 18 is attached on the insulating base 20. In this state, since the gap cover 18 is in close contact with the antenna case 10 and the insulating base 20, it is difficult to detach the gap cover 18 from the insulating base 20 during maintenance, for example.

SUMMARY

An antenna device according to one embodiment of the present invention includes an antenna base including a plurality of first fitting parts, the plurality of first fitting parts being arranged with mutual spaces therebetween in a periphery edge part of the antenna base, an antenna case fixed to the antenna base, an antenna part arranged in a space enclosed by the antenna base and the antenna case, and a cover member including a plurality of a second fitting parts, each of the plurality of the second fitting parts fitting with each of the plurality of the first fitting parts.

The cover member may have elasticity.

Each of the plurality of first fitting parts may include a concave shaped part, and each of the plurality of second fitting parts may include a column shaped part fitting with the concave shaped part.

The cover member may further include a leg part arranged in the periphery edge part and connected to a first part of a plurality of the column shaped parts, and a link part linking a second part different to the first part of the plurality of column shaped parts.

The first fitting part may lock the second fitting part.

The concave shaped part may include a shape having a different width of a concave of the concave shaped part depending on a position in a first direction pushing the second fitting part into the first fitting part.

The column shaped part may include a shape having a different width of a column of the column shaped part depending on a position in a first direction pushing the second fitting part into the first fitting part.

The antenna base may lock the cover member, the periphery edge part may include a different thickness in a cross-sectional view of the antenna base depending on a position in the first direction, and a space between the leg part and the link part may be different depending on a position in the first direction.

Each of the plurality of first fitting parts may include a convex shaped part, and each of the plurality of second fitting parts may include a concave shaped part or a through hole, the concave shaped part may fit with the convex shaped part, the through hole may pass through the cover member and fit with the convex shaped part.

The first fitting part may lock the second fitting part.

The concave shaped part or the through hole may include a shape having a different width of a concave of the concave shaped part or a hole of the through hole depending on a position in a first direction pushing the second fitting part into the first fitting part.

The convex shaped part may include a shape having a different width of a convex of the convex shaped part in a first direction pushing the second fitting part into the first fitting part.

The antenna case may include a rib for suppressing disengagement of the first fitting part and the second fitting part.

The rib may be arranged on an opposite side of the first fitting part with respect to the second fitting part.

A position where the antenna base and the antenna case are fixed may be further to .an inner side of the antenna base than a position where the first fitting part and the second fitting part are fitted.

DESCRIPTION OF EMBODIMENTS

Figure 1:
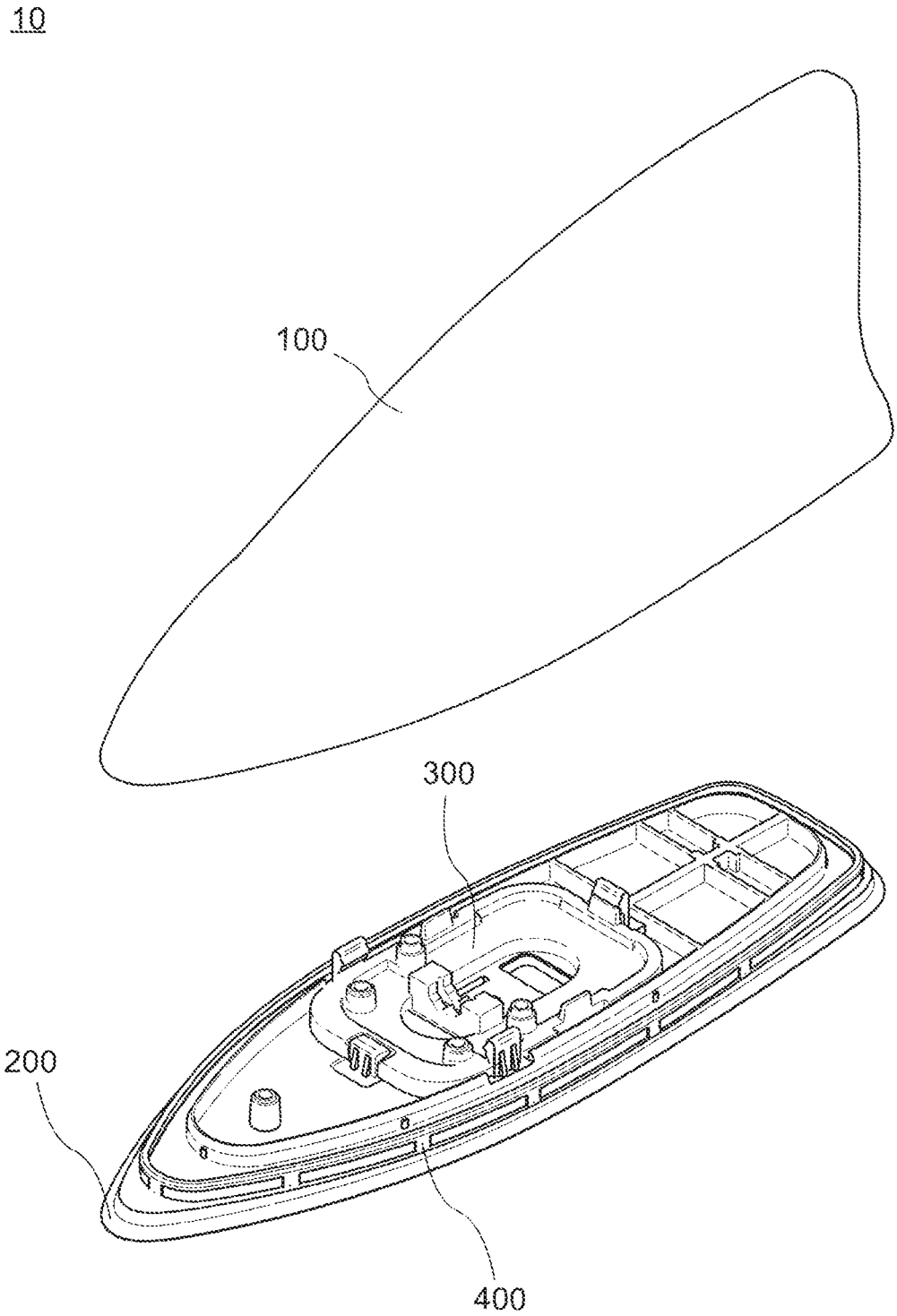
FIG. 1 is a perspective view showing an external appearance of an antenna device according to one embodiment of the present invention.

An antenna device according to the present invention is explained below while referring to the drawings. However, the antenna device of the present invention can be implemented in many different modes, and is not to be interpreted as being limited to the description of the embodiments described below. In the drawings referred to in the present embodiment, the same reference numerals are attached to the same parts or parts having similar functions, and repeated explanations of these are omitted. Although the terms "upward" or "downward" are used for the purpose of convenience of explanation, upward or downward indicates orientation in a state in which the antenna device is attached to a vehicle. Similarly, although the terms "forward" or "backward" are used in the explanation, the forward direction indicates the forward direction of a vehicle and the backward direction indicates the backward direction of a vehicle. Similarly, although an explanation is arranged using the term "lateral direction", the lateral direction indicates a direction orthogonal to the traveling direction of a vehicle. The embodiments herein aim to provide an antenna device which is attached on a roof of a vehicle having good assembly workability and maintenance workability.

<First Embodiment>

An antenna device according to a first embodiment of the present invention is explained using FIG. 1 to FIG. 8. The antenna device 10 according to the first embodiment of the present invention is an antenna device attached on a roof of a vehicle. The antenna device 10 is an antenna device called a shark fin antenna which is streamlined and becomes thinner toward the front of the vehicle. Although the antenna device attached on the roof of the vehicle is explained in the embodiments below, the place where the antenna device is attached is not limited to the roof of a vehicle. For example, the antenna device explained in the embodiments below can be attached on a spoiler or a trunk cover or the like in addition to a roof of a vehicle.

[Outline of Antenna Device]

First, an outline of the structure of an antenna device is explained using FIG. 1. The structure of each part included in the antenna device is explained later in detail. FIG. 1 is a perspective view showing an external appearance of an antenna device according to one embodiment of the present invention. FIG. 1 is a diagram showing a state in which an antenna case 100 is detached from an antenna base 200 for the convenience of explanation. As is shown in FIG. 1, the antenna device 10 includes the antenna case 100, the antenna base 200, an antenna part 300 and a cover member 400. The antenna case 100 covers the antenna part 300 and is fixed to the antenna base 200. The antenna case 100 and the antenna base 200 protect the antenna part 300 from external pressure, impacts, moisture and dust and the like. The antenna part 300 is fixed to the antenna base 200. The cover member 400 is arranged between the roof of the vehicle to which the antenna device 10 is attached and the antenna case 100. The cover member 400 maintains a space between the roof of the vehicle and the antenna case 100 and blinds a gap between the roof of the vehicle and the antenna case 100. Although described in detail herein, the cover member 400 is fitted to the antenna base 200 at a plurality of positions.

[Structure of Antenna Base]

Figure 2:
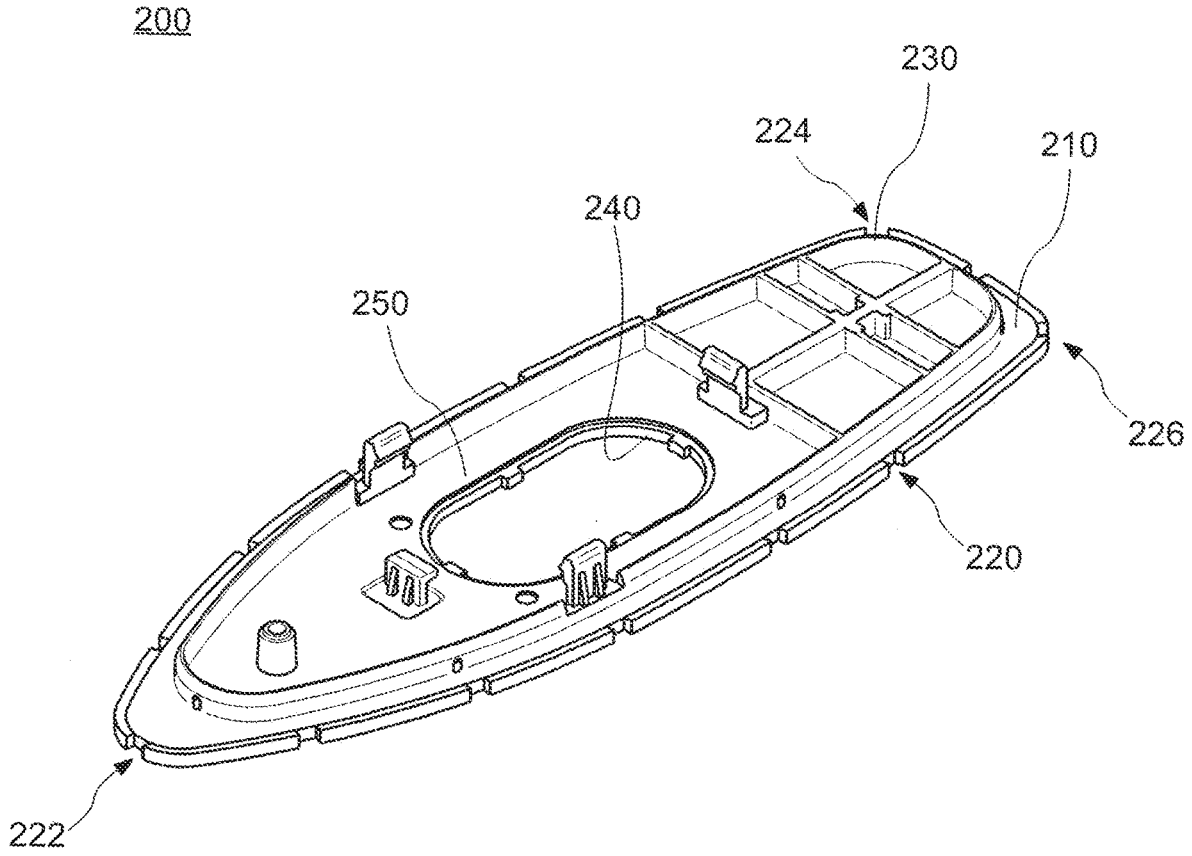
FIG. 2 is a perspective view of an antenna base in an antenna device according to one embodiment of the present invention.

The structure of the antenna base 200 used in the antenna device 10 is explained in detail using FIG. 2. FIG. 2 is a perspective view of the antenna base in the antenna device according to one embodiment of the present invention. As is shown in FIG. 2, the antenna base 200 has a periphery edge part 210, a first fitting part 220, a periphery wall part 230, an opening part 240 and an antenna attachment part 250. A synthetic resin having radio wave permeability is used for the antenna base 200. It is preferred that the antenna base 200 has rigidity sufficient to be able to hold the antenna part 300.

The periphery edge part 210 is a flat plate shaped region arranged in the vicinity of the outer periphery of the antenna base 200. Here, a region further to the outside than the periphery wall part 230 is referred to as the periphery edge part 210.

The first fitting part 220 is arranged on the outer periphery of the periphery edge part 210 and includes a concave shaped part recessed inward from the outer periphery of the periphery edge' part 210. Here, the concave shaped part can be referred to as the first fitting part 220, and the concave shaped part and the periphery edge part around the concave shaped part can also be referred to as the first fitting part 220. A plurality of first fitting parts 220 are arranged with mutual spaces therebetween. As is shown in FIG. 2, first fitting parts 222, 224, 226 among the first fitting parts 220 are arranged at the periphery edge part which is a region having a small curvature radius within the periphery edge part 210. By arranging the first fitting part 220 at the position described above, an effect of suppressing disengagement of the cover member 400 and the first fitting part 220 is improved. However, the position where the first fitting part 220 is arranged is not limited to the position described above and may be arranged in other regions. Although the first fitting part 220 is arranged to pass through a lower surface and an upper surface of the periphery edge part 210, it is not absolutely necessary that the first fitting part 220 passes through.

The periphery wall part 230 is arranged between the periphery edge part 210 and the antenna attachment part 250. The periphery wall part 230 protrudes upward with respect to the periphery edge part 210 and the antenna attachment part 250. The periphery wall part 230 is arranged at a position where it is possible to contact with a part of the antenna case 100. By irradiating the periphery edge part 210 in the vicinity of the periphery wall part 230 from the lower side of the antenna base 200 with laser irradiation in a state where the antenna case 100 and the antenna base 200 overlap each other, the periphery part 210 and a part of the antenna case 100 that contacts the periphery edge part 210 are welded together. That is, the periphery edge part 210 in the vicinity of the periphery wall part 230 functions as a fixing part of the antenna case 100 and the antenna base 200. A part of the periphery wall part 230 and a part of the antenna case 100 contacting the periphery wall part 230 may be welded together by laser irradiation. By welding the periphery wall part 230 and a part of the antenna case 100, foreign matter such as moisture and dust from the exterior is suppressed from entering into the antenna attachment part 250. Rephrasing the structure described above, the region (fixed part) where the antenna case 100 and the antenna base 200 are welded together by laser irradiation is located further to the inner side of the antenna base 200 than the first fitting part 220 and the second fitting part 410 explained later.

The opening part 240 is arranged in the antenna base 200 further to the inside than the periphery wall part 230. The opening part 240 passes through the lower surface and the upper surface of the antenna base 200. Wires such as a power supply line for supplying power to the antenna part 300 and a signal line for transmitting a signal from the antenna part 300 are supplied to the vehicle via the opening part 240. Although not shown in the diagram, a ring shaped seal is arranged on the inner periphery part of the opening part 240 in order to suppress the entry of foreign matter such as moisture and dust from the exterior into the antenna attachment part 250.

The antenna attachment part 250 is a flat plate shaped region arranged further to the inside than the periphery wall part 230. The antenna part 300 is arranged at the antenna attachment part 250. Although not shown in the diagram, the antenna attachment part 250 may have a fixing part which can fix the antenna part 300.

[Structure of Cover Member 400]

Figure 3:
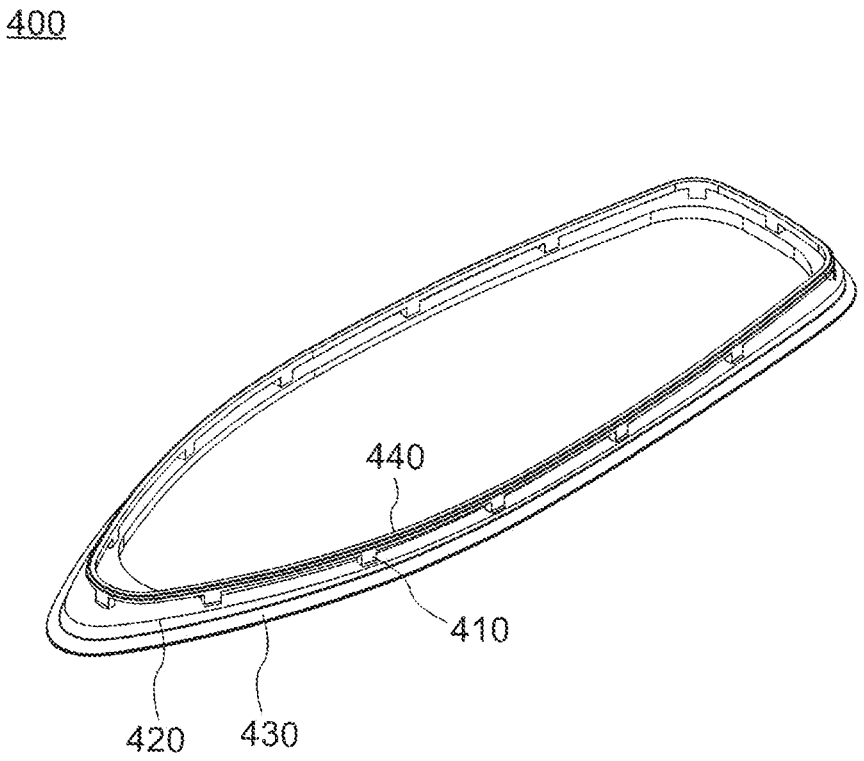
FIG. 3 is a perspective view of a cover member in an antenna device according to one embodiment of the present invention.

The structure of the cover member 400 used in the antenna device 10 is explained in detail using FIG. 3. FIG. 3 is a perspective view of the cover member of the antenna device according to one embodiment of the present invention. As is shown in FIG. 3, the cover member 400 has a second fitting part 410, a first leg part 420, a second leg part 430 and a link part 440. The cover member 400 has elasticity. For example, a resin material having elasticity such as rubber can be used for the cover member 400. Each part of the cover member 400 may be integrally formed and each part formed individually may be bonded or adhered.

The second fitting part 410 is arranged at a position corresponding to the first fitting part 220. The second fitting part 410 includes a column shaped part extending upwards from the first leg part 420. Here, the column shaped part can be referred to as the second fitting part 410, and the column shaped part, the first leg part 420 and the link part 440 around the column shaped part can also be referred to as the second fitting part 410. A plurality of second fitting parts 410 are arranged at positions corresponding to the concave shaped parts of the first fitting parts 220 with mutual spaces therebetween.

The first leg part 420 is arranged below the second fitting part 410 and is connected to one (first part) of the second fitting parts 410. The second leg part 430 is arranged below the first leg part 420 and supports the first leg part 420. As is shown in FIG. 3, the second leg part 430 is thin compared to the first leg part 420 and extends to the outer side of the first leg part 420. The angle of inclination of the second leg part 430 with respect to the roof of the vehicle is small compared to the angle of inclination of the first leg part 420. The followability to the roof of the vehicle is increased by the shape of the first leg part 420 and the second leg part 430. As a result, it is more difficult for a gap to occur between the roof of the vehicle and the antenna device 10.

The link part 440 is arranged above the second fitting part 410 and is connected to the other (second part) of the second fitting parts 410. As is shown in FIG. 3, the link part 440 is annularly arranged and arranged so as to link all of the second fitting parts 410 arranged above the first leg part 420. However, it is not necessary that all of the second fitting parts 410 be linked to the link part 440, and at least two or more second fitting parts 410 may be linked. That is, the link part 440 does not have to be annular. Although the link part 440 is shown as linking an upper end of the second fitting part 410 in FIG. 3, the present invention is not limited to this structure. For example, the link part 440 may link a section between a lower end and an upper end of the second fitting part 410.

[Shape of First Fitting Part 220 and Second Fitting Part 410]

Figure 4:
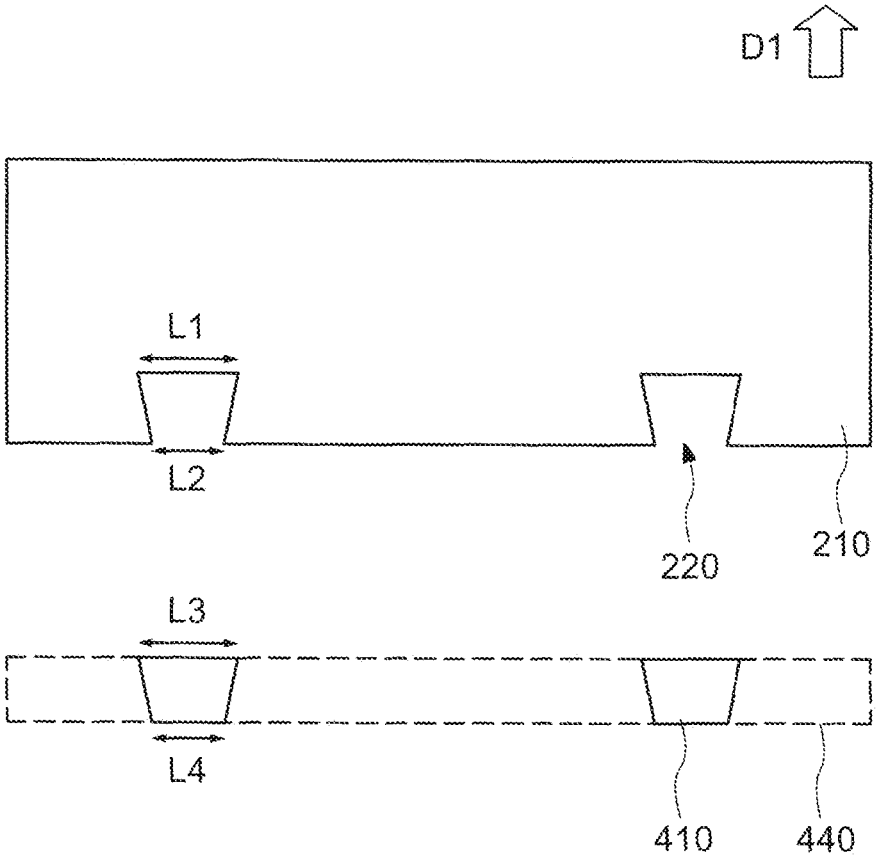
FIG. 4 is a top view diagram before fitting of a fitting part of an antenna base and a fitting part of a cover member in an antenna device according to one embodiment of the present invention.
Figure 5:
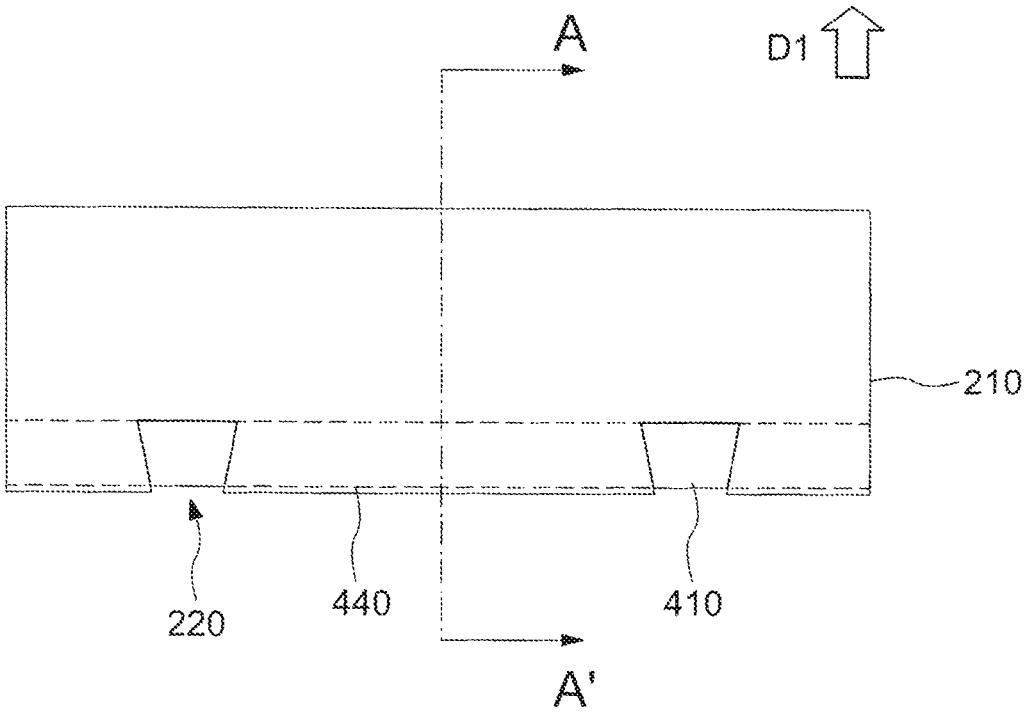
FIG. 5 is a top view diagram after fitting of a fitting part of an antenna base and a fitting part of a cover member in an antenna device according to one embodiment of the present invention.

The shape of the first fitting part 220 of the antenna base 200 and the second fitting part 410 of the cover member 400 are explained in detail using FIG. 4 and FIG. 5. FIG. 4 and FIG. 5 are top views of a fitting part of an antenna base and a fitting part of a cover member before and after fitting in the antenna device according to one embodiment of the present invention. In FIG. 4 and FIG. 5, for the purpose of convenience of explanation, the link part 440 of the cover member 400 is drawn with a dotted line and the first leg part 420 and the second leg part 430 are omitted. In the explanation below, the direction in which the second fitting part 410 is pushed into the first fitting part 220 is defined as the direction D1.

As is shown in FIG. 4, in a top view, the first fitting part 220 has a shape in which the width increases from the outer side to the inner side of the periphery edge part 210. That is, in the top view, a width L1 of an opening bottom part is larger than a width L2 of an opening end part of the first fitting part 220. In other words, it can be said that the concave shaped part of the first fitting part 220 has a shape in which the width of the concave of the concave shaped part is different depending on the position in the direction D1. The first fitting part 220 has an inclination with respect to the direction D1 from the opening end part to the opening bottom part and a width of the first fitting part 220 from the width L2 to the width L1 gradually increases.

In a top view, the second fitting part 410 has a shape in which the width increases from the outer periphery to the inner periphery of the cover member 400. That is, in a top view, a width L3 of an inner periphery end part is larger than a width L4 of an outer periphery end part of the second fitting part 410. In other words, it can be said that the column shaped part of the second fitting part 410 has a shape in which the width of the column of the column shaped part is different depending on a position in the direction D1. The second fitting part 410 has an inclination with respect to the direction D1 from the outer periphery end part to the inner periphery end part and the width of the second fitting part 410 from the width L4 to the width L3 gradually increases.

The width L3 is larger than the width L2. That is, in order to fit the second fitting part 410 and the first fitting part 220, it is necessary to push the second fitting part 410 in the direction D1. By pushing the second fitting part 410 in the direction D1, a part of the second fitting part 410 is elastically deformed and the second fitting part 410 and the first fitting part 220 are fitted together. As is shown in FIG. 5, when the first fitting part 220 and the second fitting part 410 are fitted together, the second fitting part 410 is locked with the first fitting part 220 and the second fitting part 410 is suppressed from being disengaged from the first fitting part 220.

[Cross-Sectional Shape of Antenna Base 200 and Cover Member 400]

Figure 6:
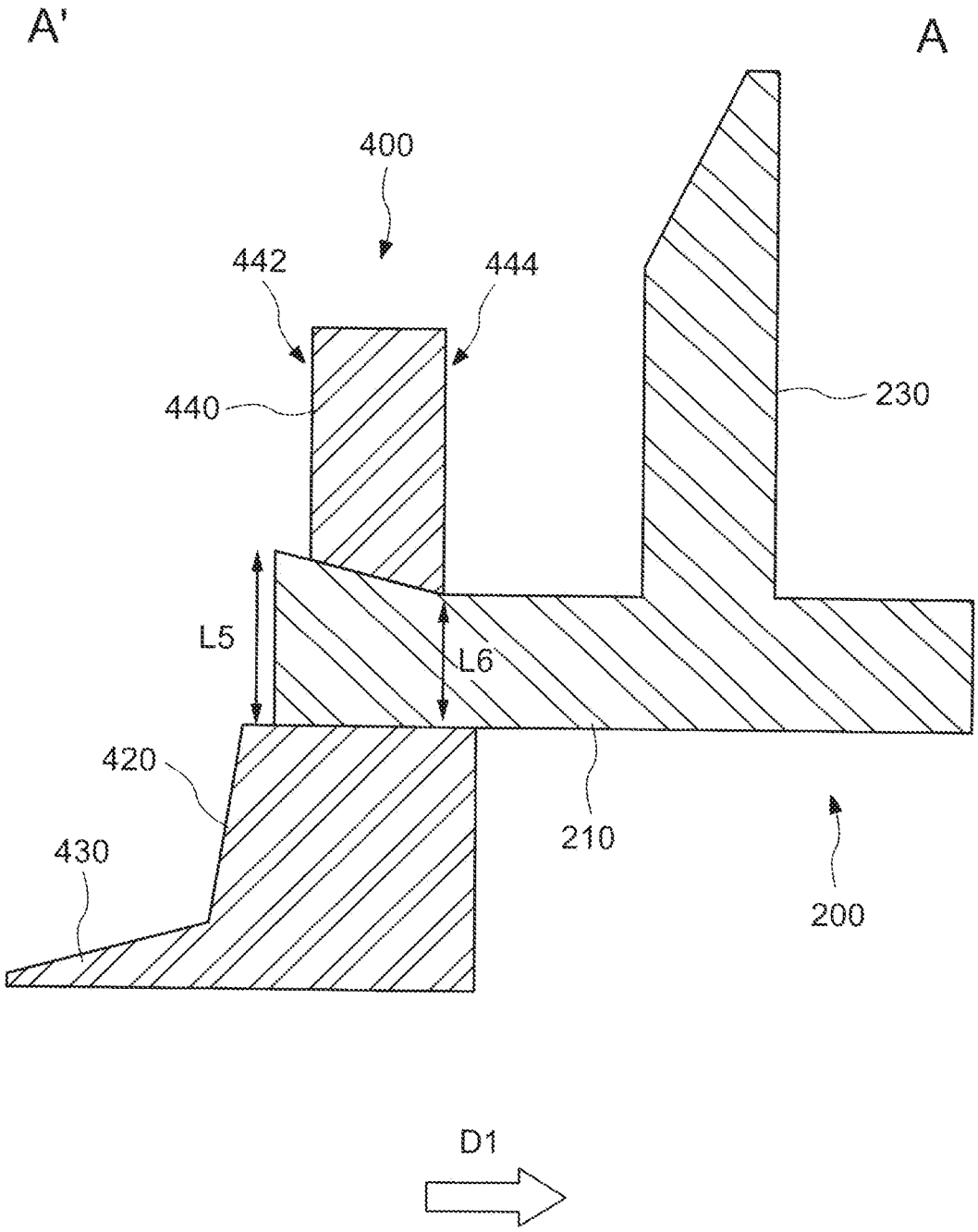
FIG. 6 is a cross-sectional diagram of the line A-A' in FIG. 5.

Cross-sectional shapes of the periphery edge part 210 of the antenna base 200, the first leg part 420, and the link part 440 in a state where the second fitting part 410 and the first fitting part 220 are fitted together is explained in detail using FIG. 6. FIG. 6 is a cross-sectional view along the line A-A' in FIG. 5. The cross-section A-A' is a cross-section of the antenna base 200 and the cover member 400 cut in the direction D1 in a region between an adjacent first fitting parts 220 and second fitting parts 410.

As is shown in FIG. 5 and FIG. 6, the periphery edge part 210 of the antenna base 200 passes through between adjacent second fitting parts 410. The thickness of the periphery edge part 210 in a cross-sectional view gradually increases from the inside of the antenna base 200 or from the side of the periphery wall part 230 towards the outer periphery of the antenna base 200. That is, in a cross-sectional view, a thickness L6 on the inner side (periphery wall part 230 side) of an outer periphery of the periphery edge part 210 is thinner than a thickness L5 on the outer periphery of the periphery edge part 210. In other words, it can be said that the periphery edge part 210 has a shape in which the thickness of the antenna base 200 in a cross-sectional view is different in the direction D1 depending on the position.

A space between the first leg part 420 and the link part 440 of the cover member 400 in a cross-sectional view becomes gradually more narrow from the outer periphery to the inner periphery of the cover member 400 so as to match the cross-sectional shape of the antenna base 200 described above. That is, in a cross-sectional view, the space between the first leg part 420 and the link part 440 at the outer periphery end part 442 of the link part 440 is large compared to the space between the first leg part 420 and the link part 440 at the inner periphery end part 444 of the link part 440. In other words, it can be said that the space between the first leg part 420 and the link part 440 is different depending on the position in the direction D1. The cover member 400 is locked with the antenna base 200 in a state in which the second fitting part 410 and the first fitting part 220 are fitted together.

[Shape of Rib (Protruding Part) of Antenna Case 100]

Figure 7:
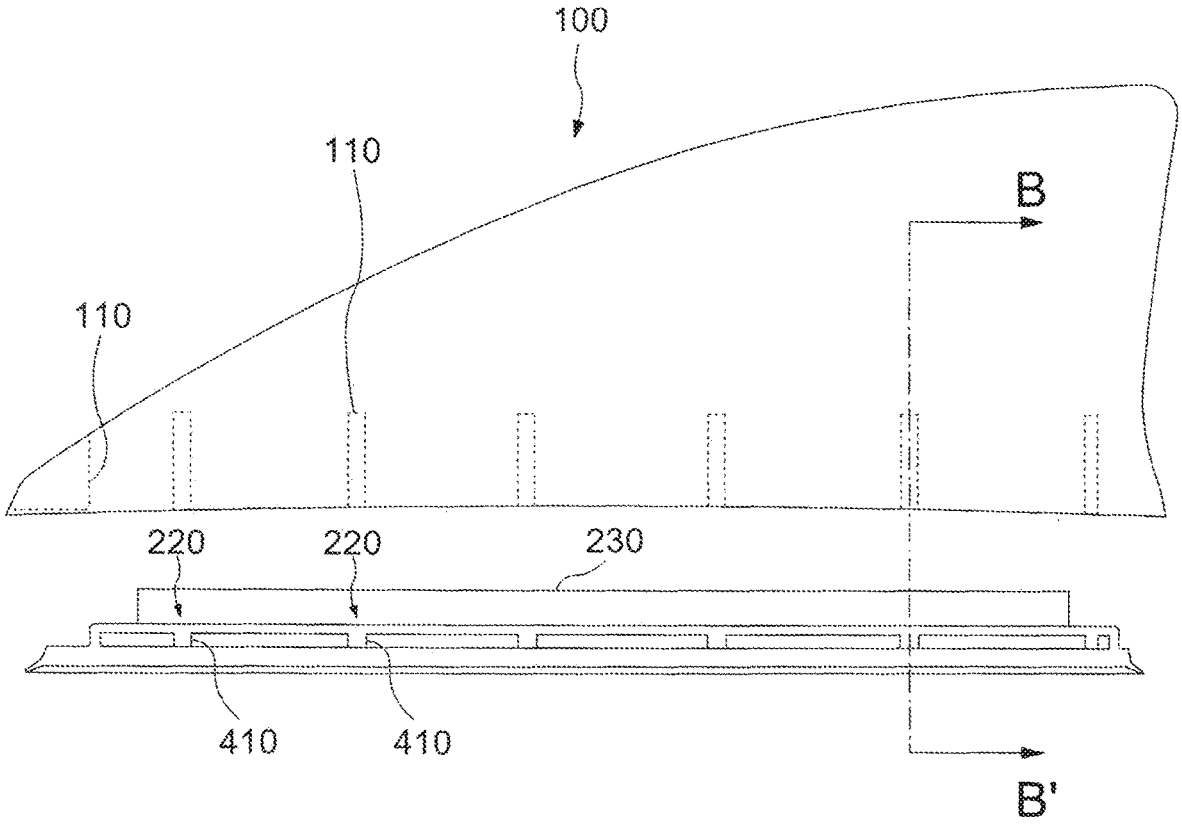
FIG. 7 is a side surface view diagram showing a positional relationship between a fitting part of a cover member and a rib of an antenna case in an antenna device according to one embodiment of the present invention.
Figure 8:
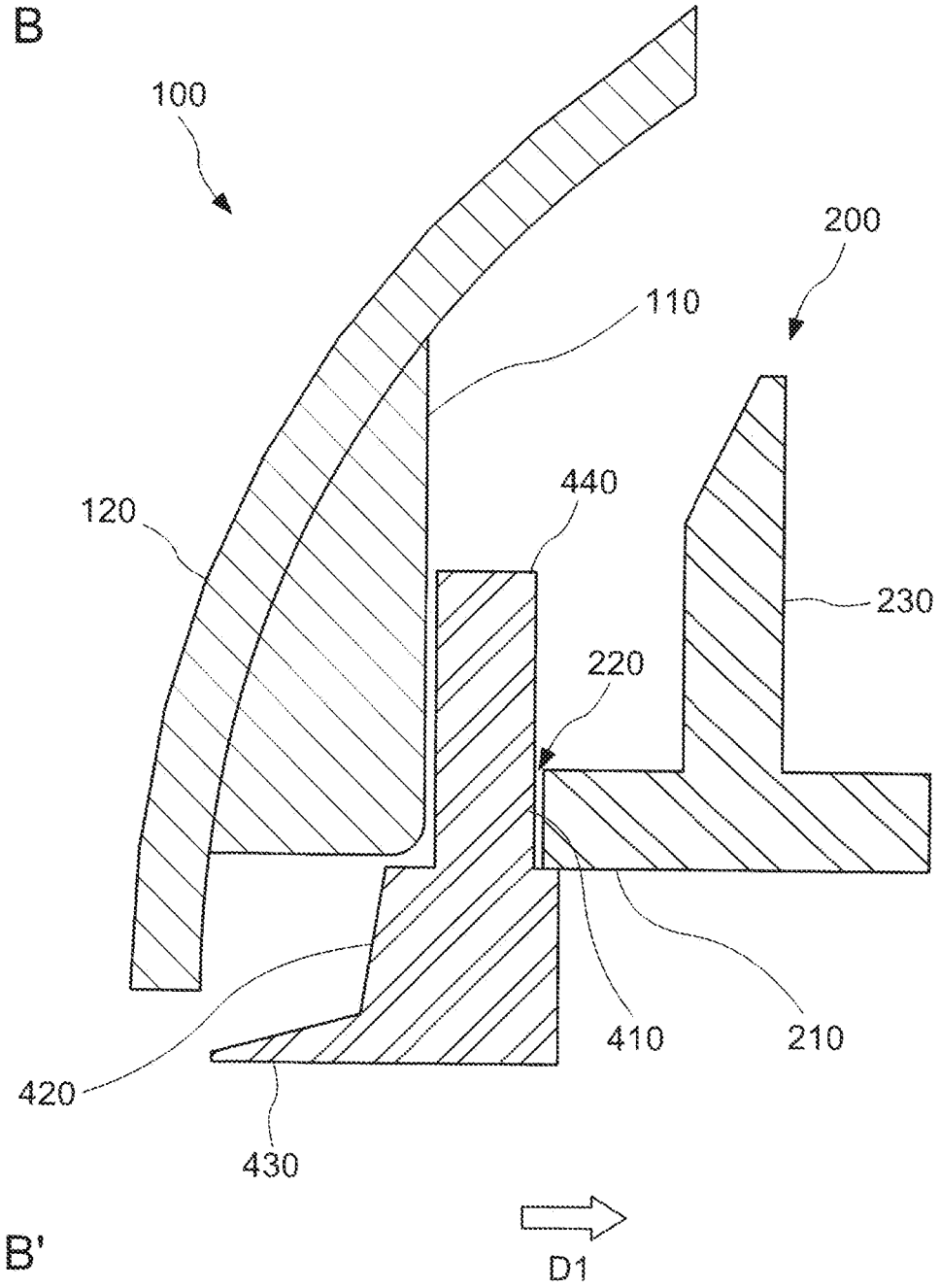
FIG. 8 is a cross-sectional diagram of the line B-B' in FIG. 7.

The shape of a protruding part arranged in the antenna case 100 is explained in detail using FIG. 7 and FIG. 8. In the following explanation, a protruding part extending from the antenna case 100 toward the inside thereof is referred to as rib 110. FIG. 7 is a side surface view showing the positional relationship between a fitting part of a cover member and the rib of the antenna case in the antenna device according to one embodiment of the present invention. FIG. 8 is a cross-sectional view along the line B-B' in FIG. 7. For the purpose of convenience of explanation, FIG. 7 shows a state in which the antenna case 100 is not fixed to the antenna base 200 but floats slightly above the antenna base 200. On the other hand, FIG. 8 shows a state in which the antenna case 100 is fixed. to the antenna base 200.

As is shown in FIG. 7, the antenna case 100 has the ribs 110 at a position corresponding to the first fitting part 220 and the second fitting part 410. The rib 110 suppresses disengagement of the first fitting part 220 and the second fitting part 410. As is shown in FIG. 8, the rib 110 is a protrusion part extending from the outer periphery wall 120 of the antenna case 100 toward the inner side of the antenna case 100. The rib 110 is arranged on the opposite side of the antenna base 200 with respect to the second fitting part 410. Although the rib 110 is a flat shaped rib in FIG. 7 and FIG. 8, it is not limited to this structure. For example, the rib 110 may be a rectangular shaped rib, a bar shaped rib, a spherical shaped rib or a protruding shaped rib that draws a parabola from the outer periphery wall 120. Although the rib 110 is arranged at a position corresponding to the first fitting part 220 and the second fitting part 410 in FIG. 7 and FIG. 8, the present embodiment is not limited to this structure. For example, the rib 110 may be arranged at a different position from the first fitting part 220 and the second fitting part 410.

As described above, according to the antenna device 10 related to the first embodiment of the present invention, since the first fitting part 220 includes a concave shaped part and the second fitting part 410 includes a column shaped part, it is possible for an operator to fit the column shaped part to the concave shaped part by pushing the column shaped part with a finger or the like. Therefore, it is possible to improve the efficiency of the attachment operation described above. Furthermore, by providing the antenna base 200 and the cover member 400 with the structure described above, it is possible to reduce the widths of the first fitting part 220 and the second fitting part 410 when viewed from above. Therefore, it is possible to widen the internal space (region enclosed by the periphery wall part 230) of the antenna base 200. Even after the antenna case 100 and the antenna base 200 are welded together, since the column shaped part of the second fitting part 410 is cut off when the lower end edge of the cover member 400 is pulled, it is possible to easily detach the cover member 400 from the antenna base 200. By providing the cover member 400 with elasticity, it is possible to utilize elastic deformation of the cover member 400 when attaching the cover member 400 to the antenna base 200. As a result, it is possible to improve the efficiency of the attachment operation described above. Since the plurality of column shaped parts are linked by the link part, it is possible to maintain the shape of the column shaped part. That is, since it is possible to suppress the column shaped part from tilting or collapsing, it is possible to improve the attachment workability described above.

Since the periphery edge part 210 of the antenna base 200 passes through between adjacent second fitting parts 410, an operator can visually confirm the fitting of the second fitting part 410 and the first fitting part 220. The width of the concave of the concaved shaped part of the first fitting part 220 and the width of the column of the column shaped part of the second fitting part 410 are different depending on the position in the direction D1 so that it is possible to suppress the cover member 400 from unintentionally being disengaged from the antenna base 200. Furthermore, when fitting the second fitting part 410 to the first fitting part 220, it is possible to convey to the operator that the locking state has been achieved by fitting as a sense of touch. That is, the operator can know that the second fitting part 410 is fitted with the first fitting part 220 from the sense of touch transmitted from a finger. Since the antenna base 200 locks the cover member 400 and the thickness of the periphery edge part 210 and the space between the first leg part 420 and the link part 440 are different depending on the position, it is possible to suppress the first fitting part 220 and the second fitting part 410 from unintentionally being disengaged from the antenna base 200 even at locations other than where the first fitting part 220 and the second fitting part 410 are fitted together.

By arranging the rib 110 on the antenna case 100, it is possible to suppress the cover member 400 from unintentionally being disengaged from the antenna base 200.

<Modified Example of First Embodiment>

Figure 9:
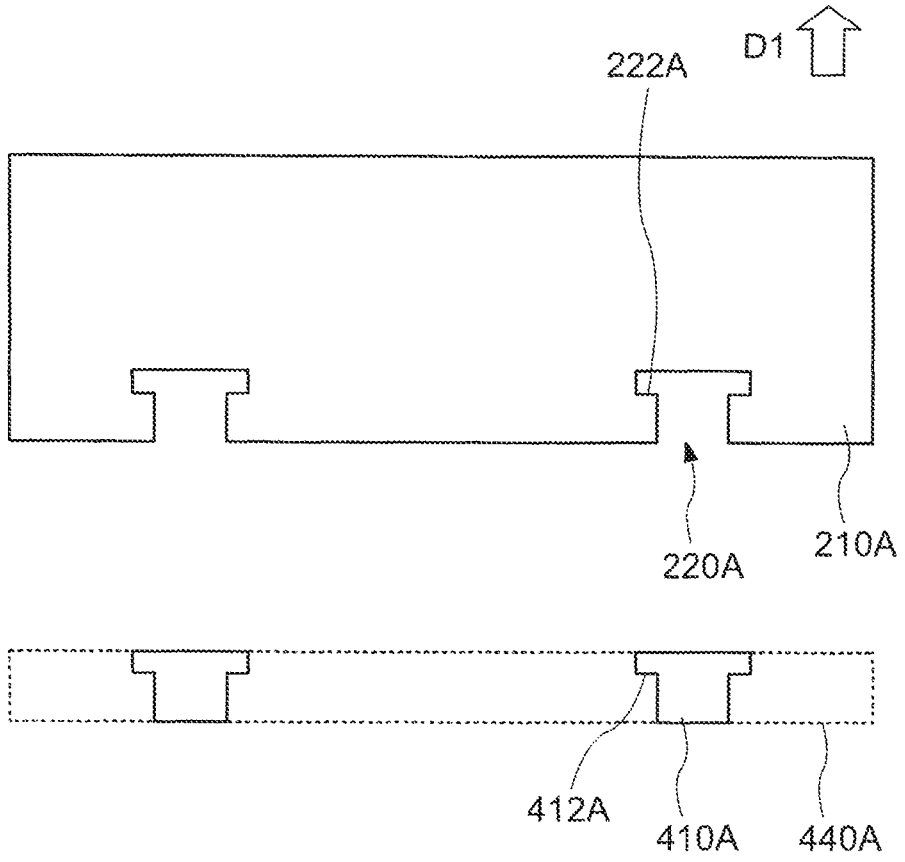
FIG. 9 is a top view diagram before fitting of a fitting part of an antenna base and a fitting part of a cover member in an antenna device according to a modified example of one embodiment of the present invention.
Figure 10:
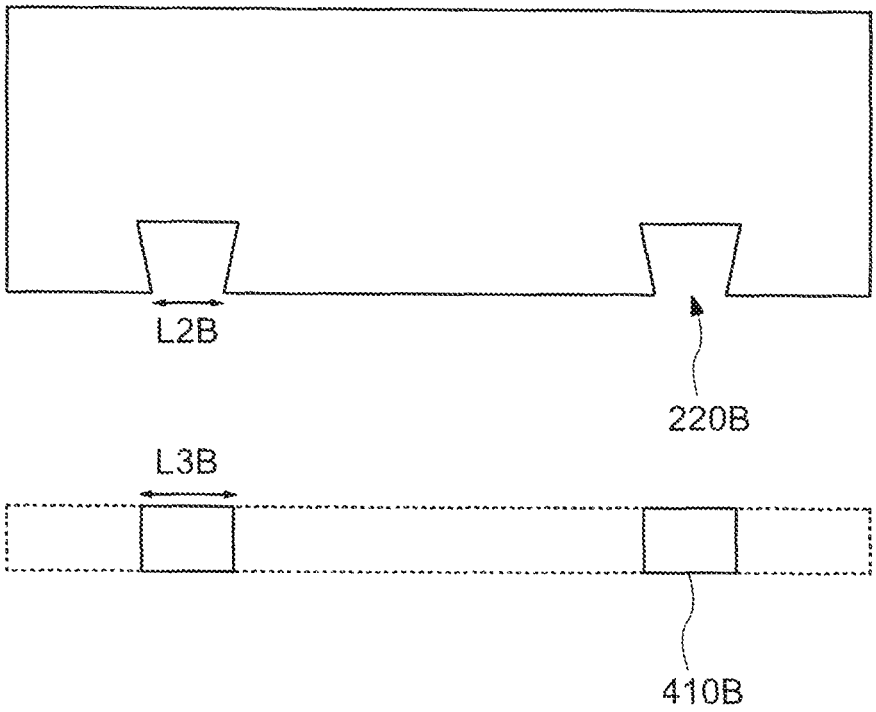
FIG. 10 is a top view diagram before fitting of a fitting part of an antenna base and a fitting part of a cover member in an antenna device according to a modified example of one embodiment of the present invention.
Figure 11:
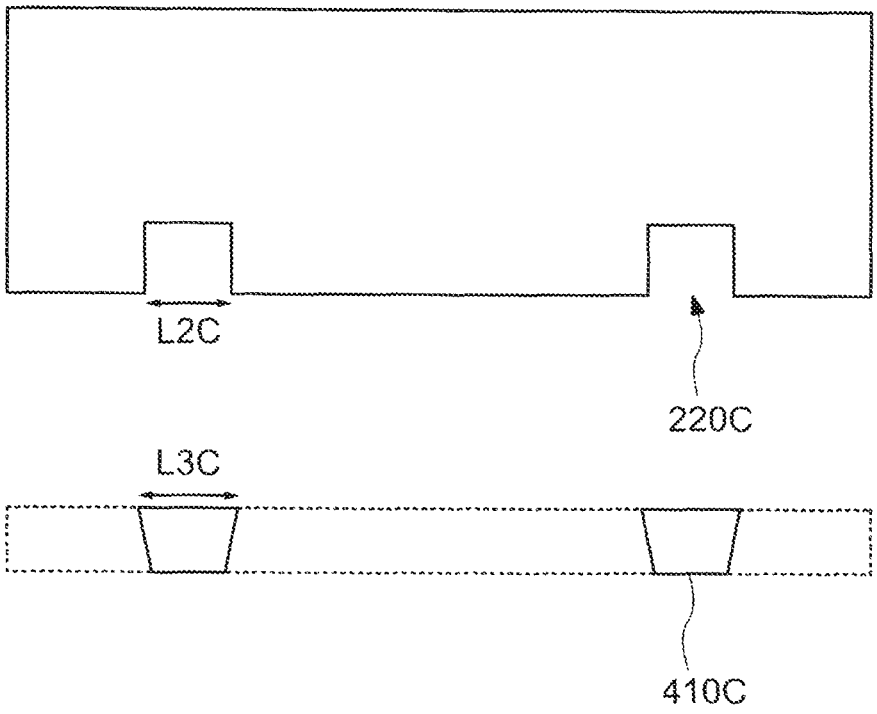
FIG. 11 is a top view diagram before fitting of a fitting part of an antenna base and a fitting part of a cover member in an antenna device according to a modified example of one embodiment of the present invention.

An antenna device according to a modified example of the first embodiment of the present invention is explained using FIG. 9 to FIG. 11. In FIG. 9 to FIG. 11, an example is explained in which the shapes of first fitting parts 220A, 2206, 220C and second fitting parts 410A, 410B, 410C are different from the shapes of the first fitting part 220 and the second fitting part 410 shown in FIG. 4. FIG. 9 to FIG. 11 are top views of the fitting part of the antenna base and the fitting part of the cover member before fitting in the antenna device according to the modified example of one embodiment of the present invention.

As is shown in FIG. 9, the first fitting part 220A has a T shape in which the inner side width of the periphery edge part 210A is larger than the outer periphery region of the periphery edge part 210A. Unlike the first fitting part 220 shown in FIG. 4, the width of the first fitting part 220A shown in FIG. 9 has a width which changes sharply at a certain point in the direction D1. The second fitting part 410A also has a similar shape as the first fitting part 220A. When the first fitting part 220A and the second fitting part 410A shown in FIG. 9 are fitted together, a first locking part 222A of the first fitting part 220A and a second locking part 412A of the second fitting part 410A are locked. The first locking part 222A and the second locking part 412A have a large angle (an angle close to 90°) with respect to the direction in which the first locking part 222A and the second locking part 412A are disengaged (reverse of the direction D1). Therefore, it is possible to further increase the effect of suppressing disengagement of the cover member 400 from the antenna base 200.

As is shown in FIG. 10 and FIG. 11, either one of the first fitting part 220 and the second fitting part 410 (the first fitting part 220B in the case of FIG. 10 and the second fitting part 410C in the case of FIG. 11) may have a different width depending on the position in the direction D1. That is, the other of the first fitting part 220 and the second fitting part 410 (the second fitting part 410B in the case of FIG. 10 and the first fitting part 220C in the case of FIG. 11) may have the same width in the direction D1. Here, the width L3B of the inner periphery end part of the second fitting part 410B is larger than the width L2B of the opening end part of the first fitting part 220B as shown in FIG. 10. The width L3C of the inner periphery end part of the second fitting part 410C is larger than the width L2C of the opening end part of the first fitting part 220C as shown in FIG. 11. The second fitting parts 410B and 410C are fitted with the first fitting parts 220B and 220C while elastically deforming and try to return to a normal state from a state of being elastically deformed in a state where both are fitted together. In this way, the second fitting parts 410B and 400C are locked with the first fitting parts 220B and 220C.

<Second Embodiment>

Figure 12:
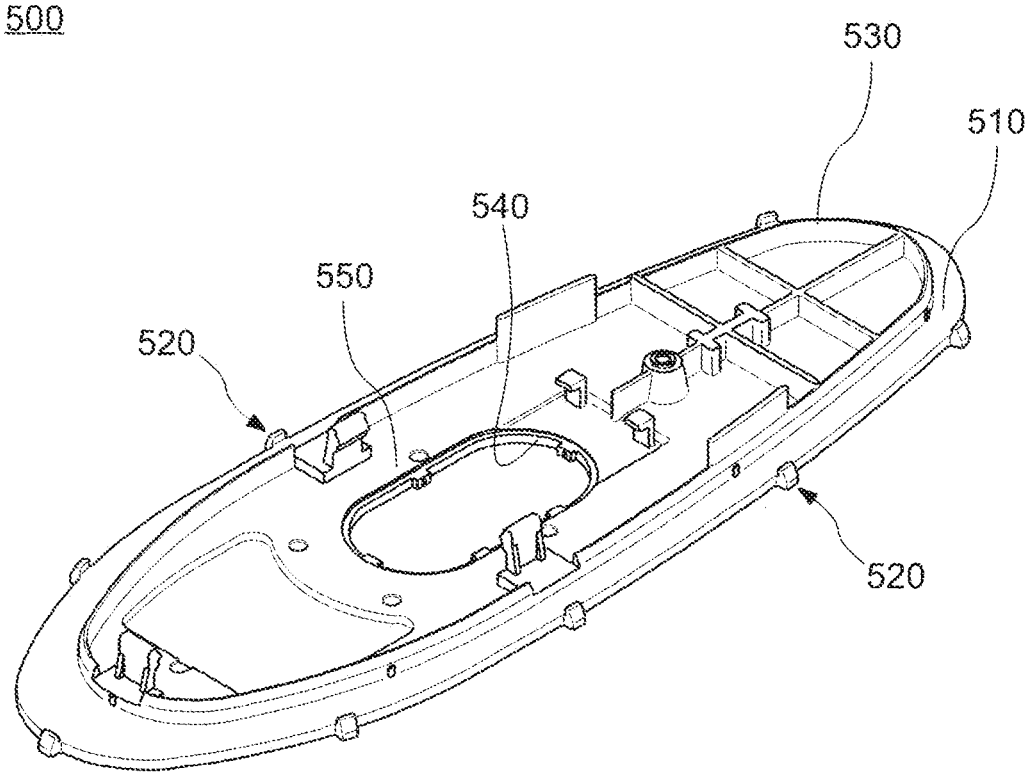
FIG. 12 is a perspective view of an antenna base in an antenna device according to one embodiment of the present invention.
Figure 13:
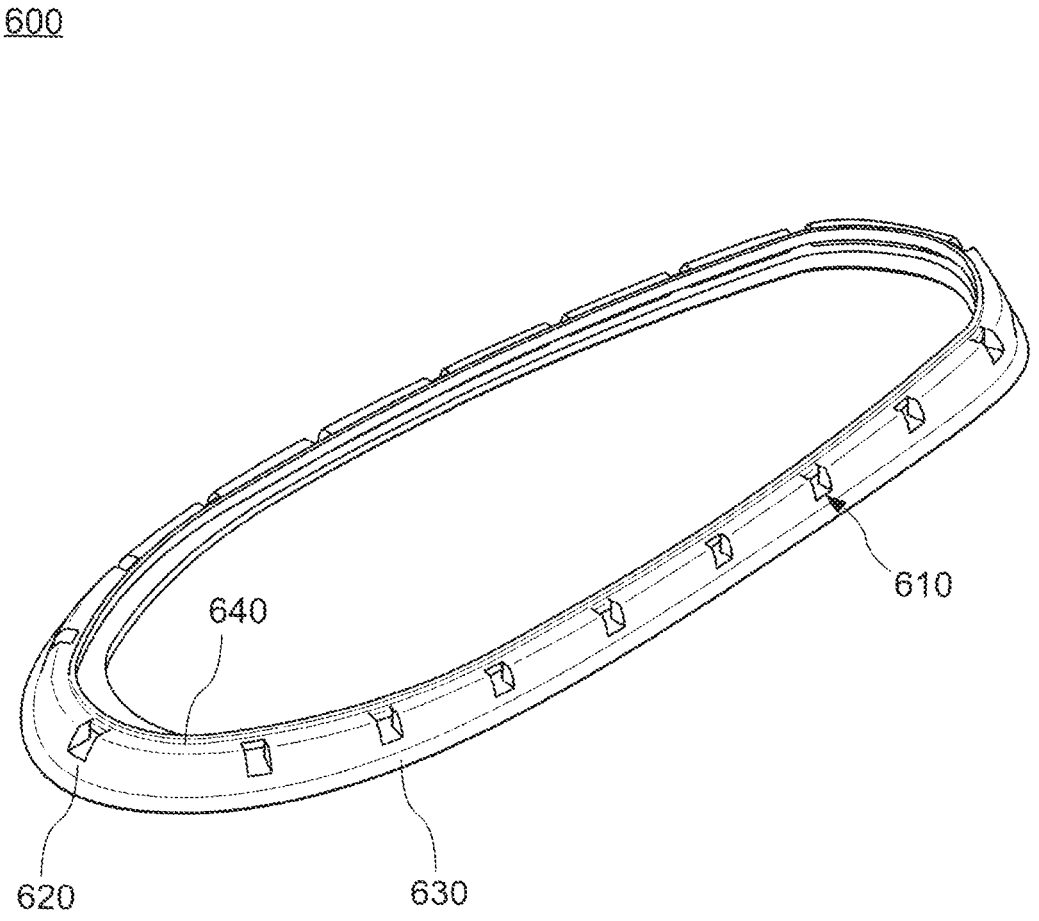
FIG. 13 is a perspective view of a cover member in an antenna device according to one embodiment of the present invention.
Figure 14:
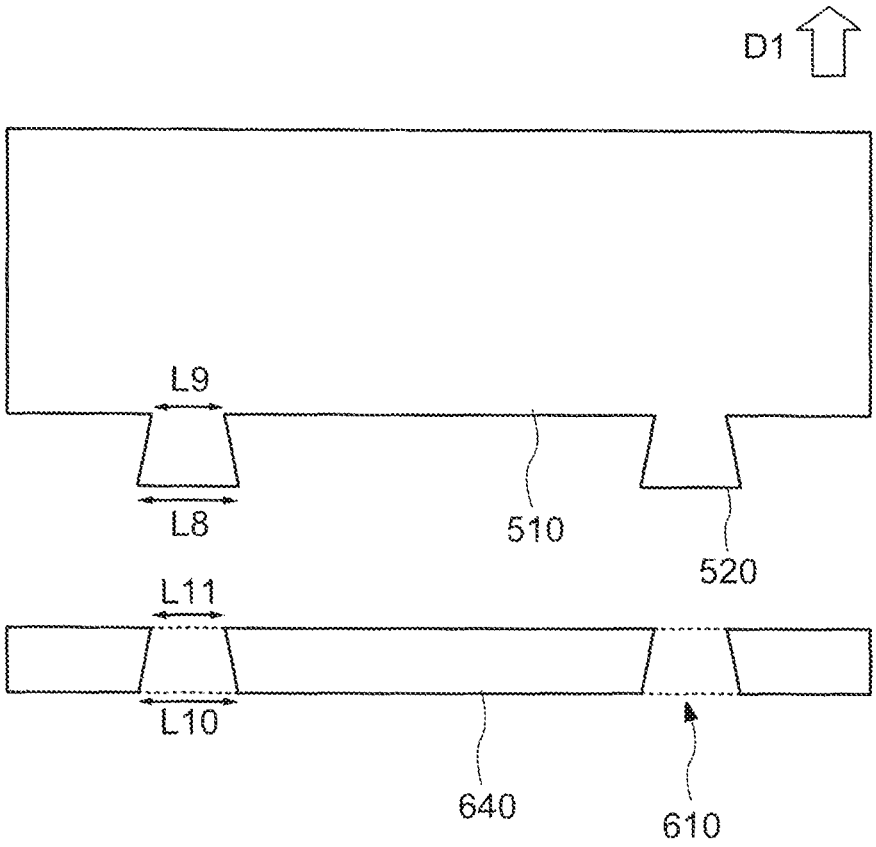
FIG. 14 is a top view diagram before fitting of a fitting part of an antenna base and a fitting part of a cover member in an antenna device according to one embodiment of the present invention.

The antenna device according to the second embodiment of the present invention is explained using FIG. 12 to FIG. 14. The antenna device 20 according to the second embodiment of the present invention is an antenna device attached to a roof of a vehicle similar to the antenna device 10 of the first embodiment. Similar to the antenna device 10, the antenna device 20 can be attached on a spoiler, a trunk cover or the like in addition to a roof of a vehicle.

[Structure of Antenna Base 500]

The structure of the antenna base 500 used in the antenna device 20 is explained in detail using FIG. 12. FIG. 12 is a perspective view of an antenna base in the antenna device according to one embodiment of the present invention. Although the antenna base 500 is similar to the antenna base 200 shown in FIG. 2, the shape of the first fitting part 520 of the antenna base 500 is different from the shape of the first fitting part 220 of the antenna base 200. In the explanation below, this difference is mainly explained.

As is shown in FIG. 12, the antenna base 500 has a periphery part 510, a first fitting part 520, a first periphery wall part 530, an opening part 540 and an antenna attachment part 550. Since the periphery edge part 510, the first periphery wall part 530, the opening part 540 and the antenna attachment part 550 have the same shape and function as those of the parts shown in the antenna base 200 in FIG. 2, an explanation of those parts is omitted.

The first fitting part 520 is arranged on the outer periphery of the periphery edge part 510 and includes a convex shaped part projecting further to the outer side from the outer periphery of the periphery edge part 510. The convex shaped part can be referred to as the first fitting part 520, and the convex shaped part and a periphery edge part around the convex shaped part can also be referred to as the first fitting part 520. A plurality of the first fitting parts 520 are arranged with mutual spaces therebetween. The first fitting part 520 can be arranged at the same position as the first fitting part 220 shown in FIG. 2. However, the position where the first fitting part 520 is arranged is not limited to the same position as that of the first fitting part 220 and may be arranged in other regions.

[Structure of Cover Member 600]

The structure of a cover member 600 used in the antenna device 20 is explained. in detail using FIG. 13. FIG. 13 is a perspective view of the cover member of the antenna device according to one embodiment of the present invention. Although the cover member 600 is similar to the cover member 400 shown in FIG. 3, the shape of a second fitting part 610 of the cover member 600 is different from the shape of the second fitting part 410 of the cover member 400. In the following explanation, this difference is mainly explained.

As is shown in FIG. 13, the cover member 600 has the second fitting part 610, a first leg part 620, a second leg part 630 and a second periphery wall part 640. The cover member 600 has elasticity similar to the cover member 400. The first leg part 620 is arranged above the second leg part 630. The first leg part 620 and the second leg part 630 are members respectively corresponding to the first leg part 420 and the second leg part 430 in FIG. 3.

The second periphery wall part 640 is arranged above the first leg part 620. The second fitting part 610 is arranged on a part of the second periphery wall part 640. The second fitting part 610 is arranged at a position corresponding to the first fitting part 520 and is fitted together with the convex shaped part of the first fitting part 520. The second fitting part 610 includes a through hole which passes through the inner side and the outer side of the second periphery wall part 640. The through hole can be referred to as the second fitting part 610, and the through hole and the second periphery wall part 640 around the through hole can also be referred to as the second fitting part 610. The cover member 600 above the second fitting part 610, that is, above the through hole, is thinner than other part of the cover member 600. With this shape, even after the antenna case 100 and the antenna base 200 are welded together, since the cover member 600 above the through hole is cut off when the lower end edge of the cover member 600 is pulled, it is possible to easily detach the cover member 600 from the antenna base 200. Similar to the antenna device 10 of the first embodiment, the antenna case 100 and the antenna base 500 are welded together by performing laser irradiation on the periphery part 510 in the vicinity of the periphery wall part 530. That is, a region (fixed part) where the antenna case 100 and the antenna base 500 are welded together by laser irradiation is located further to the inner side of the antenna base 500 than the first fitting part 520 and the second fitting part 610.

Although a structure in which the second fitting part 610 includes a through hole is exemplified in FIG. 13, the present embodiment is not limited to this structure. For example, instead of a through hole, a bottomed hole (concave shaped part) may be arranged on the inner periphery side of the second periphery wall part 640.

[Shape of First Fitting Part 520 and Second Fitting Part 610]

The shapes of the first fitting part 520 of the antenna base 500 and the second fitting part 610 of the cover member 600 are explained in detail using FIG. 14. FIG. 14 is a top view of a fitting part of an antenna base and a fitting part of a cover member before fitting in the antenna device according to one embodiment of the present invention. In FIG. 14, for the purpose of convenience of explanation, the second fitting part 610 of the cover member 600 is drawn with a dotted line.

As is shown in FIG. 14, in a top view, the first fitting part 520 has a shape in which the width increases from the outer periphery of the periphery edge part 510 further to the outer side. That is, in a top view, a width L8 of a tip part is larger than a width L9 of a bottom part of the first fitting part 520. In other words, it can be said that the convex shaped part of the first fitting part 520 has a shape in which a width of the convex of the convex shaped part is different depending on the position in the direction D1. The first fitting part 520 has an inclination with respect to the direction D1 from the bottom part to the tip part, and the width of the first fitting part 520 from the width L9 to the width L8 increases gradually.

In a top view, the second fitting part 610 has a shape in which the width narrows from the outer periphery to the inner periphery of the second periphery wall part 640. That is, in a top view, a width L11 of the inner periphery end part is smaller than a width L10 of the outer periphery end part of the second fitting part 610. In other words, it can be said that the through hole (or concave shaped part) of the second fitting part 610 has a shape in which the width of the hole (or the concave) of the through hole (or concave shaped part) is different in the D1 direction depending on the position. The second fitting part 610 has an inclination with respect to the direction D1 from the outer periphery end part to the inner periphery end part and the width of the second fitting part 610 from the width L10 to the width L11 gradually, decreases.

The width L8 is larger than the width L11. That is, in order to fit the second fitting part 610 and the first fitting part 520, it is necessary to push the second fitting part 610 in the direction D1. By pushing the second fitting part 610 in the direction D1, a part of the second fitting part 610 is elastically deformed and the second fitting part 610 and the first fitting part 520 are fitted together. As is shown in FIG. 14, when the first fitting part 520 and the second fitting part 610 are fitted together, the second fitting part 610 is locked with the first fitting part 520 and the second fitting part 610 is suppressed from being disengaged from the first fitting part 520.

As is described above, according to the antenna device 20 according to the second embodiment of the present invention, the first fitting part 520 includes a convex shaped part and the second fitting part 610 includes a through hole. Therefore, it is possible for an operator to fit the through hole into the convex shaped part by pushing the vicinity of the through hole with a finger or the like. With this structure, it is possible to visually confirm the fitting of the first fitting part 520 and the second fitting part 610. Therefore, it is possible to improve the efficiency of the attachment operation described above. Furthermore, by providing the antenna base 500 and the cover member 600 with the structure described above, it is possible to reduce the width of the first fitting part 520 and the second fitting part 610 when viewed from above. Therefore, it is possible to widen the internal space (area enclosed by the periphery wall part 530) of the antenna base 500. By adopting a structure in which a through hole is .arranged in a part of the second periphery wall part 640, it is possible to improve the mechanical strength of the cover member 600.

According to the embodiments described above, it is possible to provide an antenna device with good attachment workability and good maintenance workability.

Furthermore, the present invention is not limited to the embodiments described above and appropriate modifications can be made within a scope that does not depart from the concept of the invention.

What is claimed is:

1. An antenna device comprising:

an antenna base including a plurality of first fitting parts, the plurality of first fitting parts being arranged with mutual spaces therebetween in a periphery edge part of the antenna base;

an antenna case fixed to the antenna base;

an antenna part arranged in a space enclosed by the antenna base and the antenna case; and a cover member including a plurality of a second fitting parts, each of the plurality of the second fitting parts fitting with each of the plurality of the first fitting parts, the cover memeber being at least partially arranged between the antenna base and the antenna case.

2. The antenna device according to claim 1, wherein the cover member has elasticity.

3. The antenna device according to claim 1, wherein each of the plurality of first fitting parts includes a concave shaped part, and each of the plurality of second fitting parts includes a column shaped part fitting with the concave shaped part.

4. The antenna device according to claim 3, wherein the cover member further includes a leg part connected to a first part of a plurality of the column shaped parts, and a link part linking a second part different to the first part of the plurality of column shaped parts.

5. The antenna device according to claim 4, wherein the first fitting part locks the second fitting part.

6. The antenna device according to claim 5, wherein the concave shaped part includes a shape having a different width of a concave of the concave shaped part depending on a position in a first direction pushing the second fitting part into the first fitting part.

7. The antenna device according to claim 5, wherein the column shaped part includes a shape having a different width of a column of the column shaped part depending on a position in a first direction pushing the second fitting part into the first fitting part.

8. The antenna device according to claim 6, wherein the antenna base locks the cover member, the periphery edge part includes a different thickness in a cross-sectional view of the antenna base depending on a position in the first direction, and a space between the leg part and the link part is different depending on a position in the first direction.

9. The antenna device according to claim 1, wherein each of the plurality of first fitting parts includes a convex shaped part, and each of the plurality of second fitting parts includes a concave shaped part or a through hole, the concave shaped part fits with the convex shaped part, the through hole fits with the convex shaped part and passes through the cover member.

10. The antenna device according to claim 9, wherein the first fitting part locks the second fitting part.

11. The antenna device according to claim 10, wherein the concave shaped part or the through hole includes a shape having a different width of a concave of the concave shaped part or a hole of the through hole depending on a position in a first direction pushing the second fitting part into the first fitting part.

12. The antenna device according to claim 10, wherein the convex shaped part includes a shape having a different width of a convex of the convex shaped part in a first direction pushing the second fitting part into the first fitting part.

13. The antenna device according to claim 1, wherein the antenna case includes a rib for suppressing disengagement of the first fitting part and the second fitting part.

14. The antenna device according to claim 13, wherein the rib is arranged on an opposite side of the first fitting part with respect to the second fitting part.

15. The antenna device according to claim 1, wherein a position where the antenna base and the antenna case are fixed is further to an inner side of the antenna base than a position where the first fitting part and the second fitting part are fitted.

* * * * *